US006076214A

United States Patent [19]

Klimenko

[11] Patent Number: 6,076,214

[45] Date of Patent: Jun. 20, 2000

[54] INFLATABLE MATTRESS ASSEMBLIES

[75] Inventor: Konstantin Klimenko, Los Angeles, Calif.

[73] Assignee: Sevylor U.S.A., Inc., Los Angeles, Calif.

[21] Appl. No.: 09/274,649

[22] Filed: Mar. 23, 1999

Related U.S. Application Data

[60] Provisional application No. 60/096,164, Aug. 11, 1998.

[51] Int. Cl.[7] ..... A47C 27/10

[52] U.S. Cl. ..... 5/710; 5/706

[58] Field of Search ..... 5/710, 711, 712, 5/706, 691

[56] References Cited

U.S. PATENT DOCUMENTS

| | | | |
|---|---|---|---|
| 1,371,919 | 3/1921 | Mahony | 5/710 |
| 2,604,641 | 7/1952 | Reed | 5/711 |
| 3,513,489 | 5/1970 | Miller et al. | 5/710 |
| 4,876,756 | 10/1989 | Vaccaro | 5/710 |
| 5,493,742 | 2/1996 | Klearman | 5/423 |
| 5,604,945 | 2/1997 | Fisher et al. | 5/706 |

OTHER PUBLICATIONS

Eleven pages fromthe Website www.sealy.com as they appeared on Apr. 9, 1999.

*Primary Examiner*—Alexander Grosz

*Attorney, Agent, or Firm*—Dean W. Russell; Kilpatrick Stockton LLP

[57] ABSTRACT

Inflatable mattress assemblies are disclosed. Typically including separately inflatable upper and lower components sealed one to the other, the assemblies nevertheless can create appearances of having been formed merely by laying each upper component atop the corresponding lower component. By incorporating inflatable frames around the central sections of each of the two components, the components may be sealed (welded) together at locations other than their extreme outer edges.

8 Claims, 3 Drawing Sheets

INFLATABLE MATTRESS ASSEMBLIES

REFERENCE TO PROVISIONAL APPLICATION

This application is based on and hereby refers to U.S. Provisional Patent Application Ser. No. 60/096,164, filed Aug. 11, 1998, having the same title as appears above.

FIELD OF THE INVENTION

This invention relates to mattresses and more particularly to mattress assemblies having separately-inflatable upper and lower components, or layers, which can be sealed together at locations other than at their extreme outer seams or edges.

BACKGROUND OF THE INVENTION

U.S. Pat. No. 5,604,945 to Fisher, et al., incorporated herein in its entirety by this reference, discloses an inflatable mattress having a series of parallel inner tubes positioned between substantially larger parallel outer tubes. According to the Fisher patent, this structure causes a reclining user to be "partially enwrapped by the mattress" when all tubes are inflated. This enwrapping or envelopment purportedly reduces the tendency of the user to slide off the mattress surface, while having "sections which are inflatable to differing dimensions" supposedly permits creation of "a stable and reclining level surface for the user" even when the mattress is positioned on "uneven land surfaces."

The recreational mattresses of the Fisher patent may include I- or X-beam seals for the tubes as described therein. The Fisher patent additionally illustrates and discloses a "pillow tube" utilizing a separate valve from that used to inflate the parallel inner and outer tubes. It does not, however, detail any separately inflatable components or layers stacked vertically when the mattresses are deployed.

U.S. Pat. No. 5,493,742 to Klearman, while not disclosing any recreational mattress, does discuss a two-component air mattress designed to reduce bed sores and blisters for those persons confined to bed for extended periods of time. Included in the mattress are an inflatable base having openings spaced about its upper surface. These openings characterize the base as a "ventilating" one, which according to the Klearman patent is surrounded by a foam frame for support.

Positioned atop the base of the Klearman patent is an inflatable, quilted mattress pad including upper and lower portions and a layer of down padding therebetween. A zipper may be employed to close the pad, whose upper and lower portions are stitched together in a "generally orthogonal pattern" to form multiple pockets. A single pump pressurizes the air of both the base and the pad, with air escaping the holes of the base inflating the pockets of the down-filled pad "due to the differential air pressure drop across the lower and upper layers of the quilted cover surface." As noted in the Klearman patent (which is also incorporated herein in its entirety by this reference), the quilted pad or cover encloses both the base and its foam frame, thereby precluding any appearance of the pad merely lying atop the mattress base.

SUMMARY OF THE INVENTION

The present invention, by contrast, presents such an appearance. Unlike existing inflatable mattresses, those of the invention include an upper, quilted component that need not enclose the lower component and its frame. Instead, the upper component itself includes a frame which can be sealed to the frame of the lower component, integrating the two components into a single mattress assembly. Each of the upper and lower components remains separately inflatable (typically with air), however, enhancing the options available for the user's comfort. As an example, users can inflate the lower component of the assembly firmly to provide extensive body support while inflating the upper component, or "pillow" section, only to the extent they desire for optimal comfort.

In some embodiments of the invention, the lower component of the assembly is an inflatable mattress having box construction and utilizing I-beam-style internal seals. The upper component is quilted, lacks any down filling, and uses X-beam-type internal seals. Both components may be made of polyvinyl chloride (PVC), although those skilled in the art will recognize other materials may be used for either or both of the upper and lower components as necessary or desired.

Forming the lower component in these embodiments are a central "mattress" section and a surrounding frame. Typically (but not necessarily) the central section and frame are inflated separately and lack fluid communication, so each may include its own valve or other interface with inflation equipment. Exemplary valves include Boston valves, with a recessed version being placed on either the upper or lower surface of the central section and a separate valve placed on the side of the frame. Again, however, other types of valves may be utilized and they may be positioned other than as described in the preceding sentence.

Like the lower component of the assemblies, the upper quilted component typically also includes a central "pillow" section and a surrounding frame. Preferred embodiments of this upper component permit fluid communication between the pillow section and frame, so only a single valve or other inflation interface is necessary to inflate both. Nonetheless, the invention additionally contemplates having pillow sections and surrounding frames which do not permit fluid communication.

By sealing the frame of the upper component to the frame of the lower component, an appearance, or illusion, of a two-piece construction (with the pillow section lying atop the mattress section) can be created. This construction is a hallmark of conventional high-quality non-inflatable mattresses. Simulating such a construction for inflatable mattresses, therefore, can increase their commercial appeal.

Sealing the frames of the upper and lower components also avoids the need to seal, or weld, the extreme outer seams of the components together. Welding seams in this manner may be difficult in certain circumstances. It also presents an appearance more like that of lesser-quality non-inflatable mattresses, inconsistent with at least one objective of the present invention.

Objects of the present invention thus include forming an inflatable mattress assembly in which one component is sealed to another, separately inflatable component.

Another object of the present invention is to provide an inflatable mattress assembly in which the components are sealed together at locations other than their extreme outer edges, thereby enhancing an appearance of one component merely lying atop a second component.

It is also an object of the present invention to provide inflatable frames surrounding the central sections of both the upper and lower components, each adapted to be sealed to the other.

It is an additional object of the present invention to provide a frame surrounding the central section of the lower component that may be inflated separately from the central section.

It is a further object of the present invention to provide a frame surrounding the central section of the upper component that may permit fluid to communicate therebetween.

Other objects, features, and advantages of the present invention will become apparent with reference to the remainder of the text and the drawings of this application.

DETAILED DESCRIPTION

Figure 1:
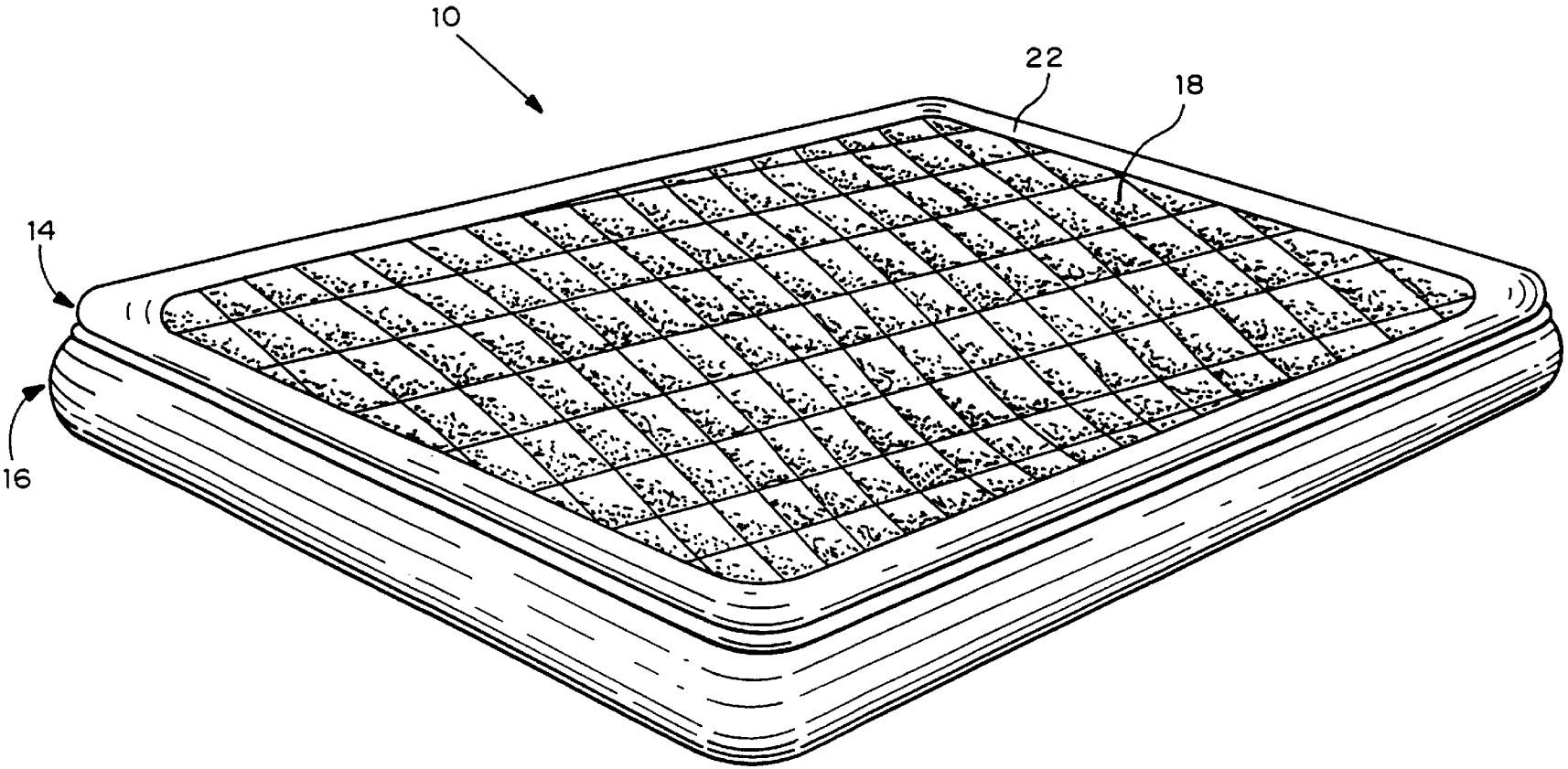
FIG. 1 is a perspective view of an exemplary mattress assembly of the present invention.

Shown in FIG. 1 is an example of an inflatable mattress assembly 10 of the present invention. Assembly 10 contains upper component 14 and lower component 16, which in most embodiments are sealed to form an integrated device. As illustrated in FIG. 1, upper component 14 does not necessarily appear to be sealed to lower component 16, but rather could, under casual observation, seem to be merely lying atop lower component 16.

In the assembly 10 of FIG. 1, upper component 14 is principally of quilted construction, like the cover of the mattress of the Klearman patent, although not filled with down. Lower component 16, by contrast, has a box-like construction. Much like many features of the invention described herein, however, those skilled in the art will recognize that other constructions may be employed without departing from the scope of the present invention.

Figure 2:
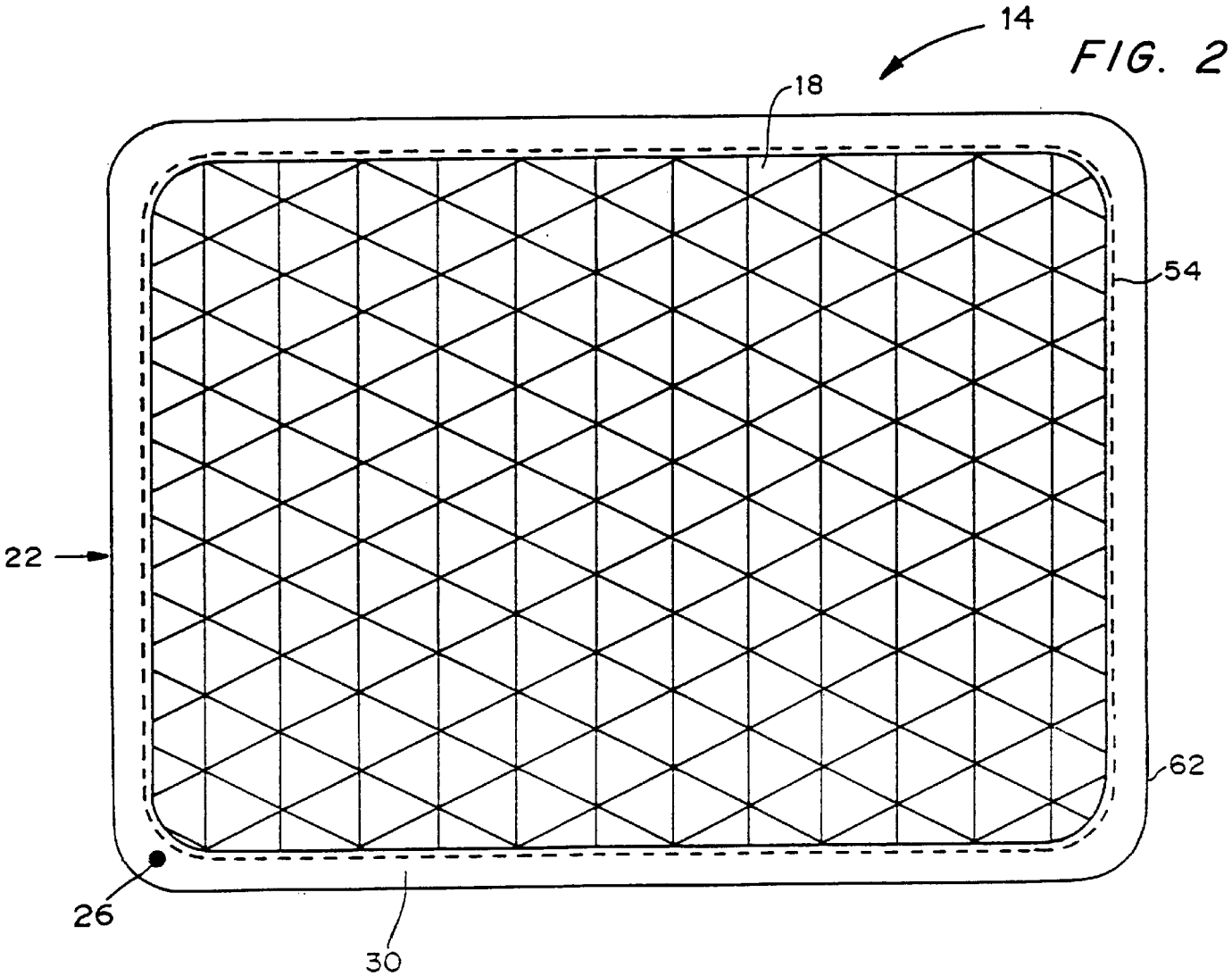
FIG. 2 is a top view of the upper component of the assembly of FIG. 1.

FIGS. 1–2 detail aspects of upper component 14 of assembly 10. Included as part of upper component 14 are central section 18 and frame 22, the latter of which is connected to and surrounds part or all of the peripheral sides of the former. Central section 18 is quilted, usually employing an X-beam-style of construction, while frame 22 typically is not quilted but rather simply formed of one or more tubes. Because in many embodiments of assembly 10 air can flow between central section 18 and internal openings of frame 22, only one valve 26 is necessary to inflate both. As illustrated in FIG. 2, valve 26 may be located on upper surface 30 of frame 22 and if desired may be adapted to be pushed into the interior of frame 22 following use for inflation. Alternatively, a second valve may be utilized to inflate central section 18 directly. Unlike the mattress of the Klearman patent, however, upper and lower components 14 and 16 do not permit air or similar fluid communication between them, so neither valve 26 nor the possible second valve discussed above could be used to inflate any portion of lower component 16.

Figure 3:
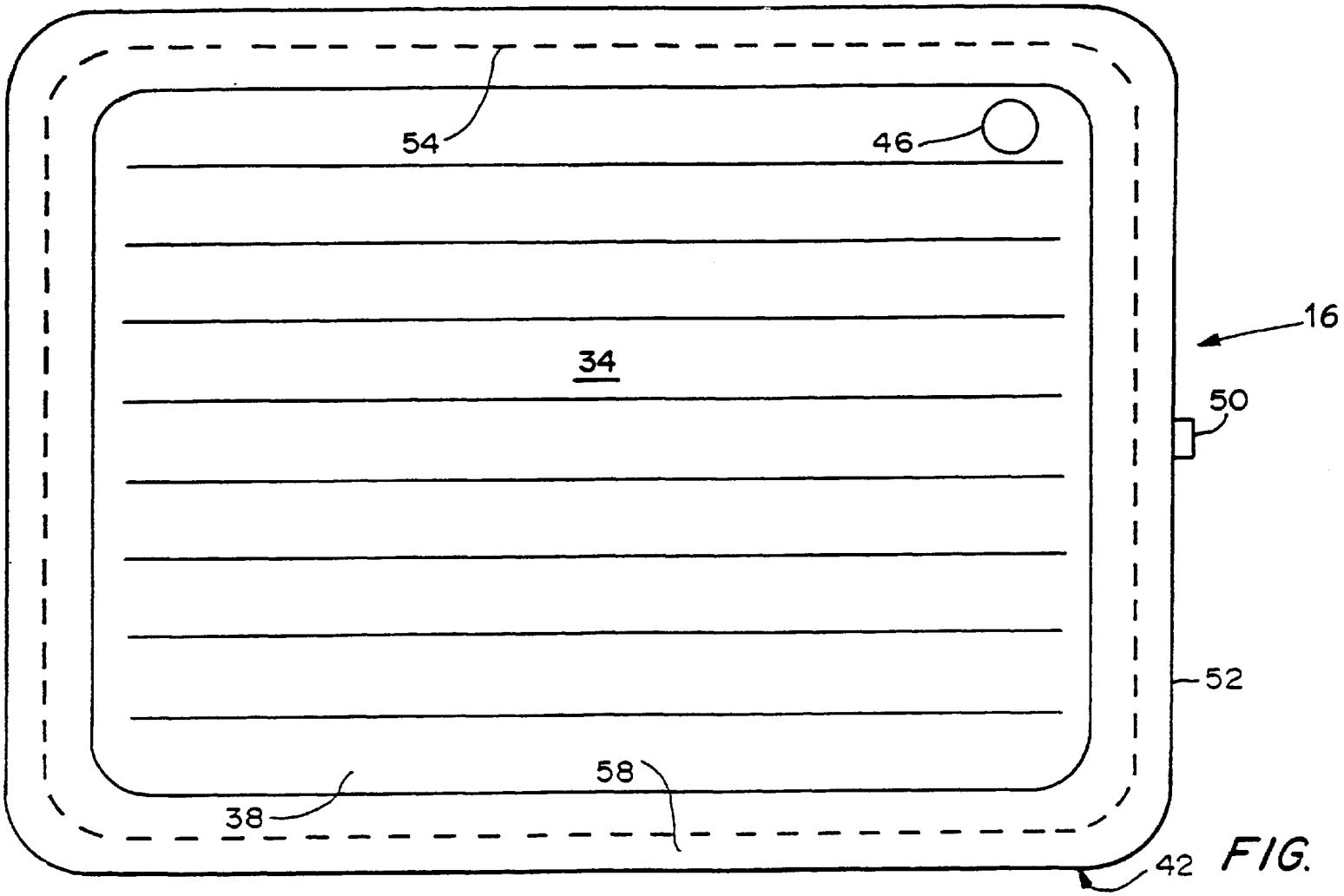
FIG. 3 is a top view of the lower component of the assembly of FIG. 1.

FIG. 3 shows upper surface 34 of lower component 16. Like upper component 14, lower component 16 may include two sections, a central section 38 and a frame 42. Frame 42 is attached to and surrounds some or all of the peripheral sides of central section 38, the latter of which is typically of an I-beam type of construction. Illustrated in FIG. 3 are valves 46 and 50, with valve 46 usually being positioned either on upper surface 34 or on the lower surface of component 16 and valve 50 often placed in the outer peripheral edge 52 of frame 42. Valves 46 and 50 may, but need not, be Boston valves, with the former recessed below upper surface 34 (if positioned on that surface) to avoid protruding into upper component 14 when components 14 and 16 are stacked vertically. Consistent with many embodiments of the invention, valve 46 may be used to inflate central section 38, while valve 50 is needed to inflate frame 42, which has no fluid communication with the central section 38. Again, however, those skilled in the art will recognize other constructions may be made within the scope of the invention.

A particular embodiment of assembly 10 detailed in FIGS. 2–3 has upper and lower components 14 and 16 of generally rectangular cross-section, with each being approximately eighty inches long and sixty and one-half inches wide. Frame 22 in this embodiment has width of approximately three inches and surrounds the entire periphery of the sides of central section 18. Frame 42, by contrast, is approximately five and one-half inches wide, although it likewise surrounds the entire periphery of the sides of central section 38.

Shown as dotted line 54 in both FIGS. 2 and 3 is the location where the underside of frame 22 is welded, or sealed, to upper surface 58 of frame 42. However, notwithstanding this permanent connection, upper and lower components 14 and 16 of assembly 10 can continue to appear to be two separate pieces (one lying atop the other), as line 54 (representing the weld seam) is not immediately visible at any outer edge of the assembly 10. Instead, line 54 is as much as two and one-half inches within peripheral edges 62 and 52 of upper and lower components 14 and 16 and thus effectively is invisible once components 14 and 16 are connected.

A user may inflate each of the upper and lower components 14 and 16 separately, with lower component 16 forming a "mattress" and typically being fully or almost fully inflated for firmness in bodily support. Upper component 14, to the contrary, is inflated only to the extent desired for comfort, forming a "pillow" on which the body of the user actually rests. Nonetheless, because it is not dependent on air escaping lower component 16 for inflation, upper component 14 may be inflated to a greater extent than, for example, the quilted cover described in the Klearman patent.

The foregoing is provided for purposes of illustrating, explaining, and describing embodiments of the present invention. Further modifications and adaptations to these embodiments will be apparent to those skilled in the art and may be made without departing from the scope or spirit of the invention.

I claim:

1. An inflatable mattress comprising:

a. a sealable lower component comprising:
   i. a central section; and
   ii. a frame attached to and at least partially surrounding the central section of the lower component, the frame defining:
      A. an upper surface; and
      B. a peripheral edge; and b. a sealable upper component attached to the lower component and comprising:
   i. a central section; and
   ii. a frame attached to and at least partially surrounding the central section of the upper component, the frame defining:
      A. a lower surface; and
      B. a peripheral edge.

2. An inflatable mattress according to claim 1 in which the upper surface of the frame of the lower component is connected to the lower surface of the frame of the upper component at a position other than at the peripheral edge of either frame.

3. An inflatable mattress according to claim 1 in which the upper component is sealed from the lower component so as to preclude fluid communication between them.

4. An inflatable mattress according to claim 1 in which the central section and frame of the lower component lack fluid communication, further comprising a valve included in each of the central section and frame of the lower component for independent inflation thereof.

5. An inflatable mattress according to claim 4 in which the central section and frame of the upper component have fluid communication, further comprising a valve included in at least one of the central section and frame of the upper component for concurrent inflation thereof.

6. An inflatable mattress according to claim 1 in which the upper component lacks down and at least a portion thereof is quilted.

7. An inflatable mattress according to claim 6 in which the central section of the upper component is quilted and of X-beam construction and the central section of the lower component is of I-beam construction.

8. An inflatable mattress comprising:

a. a lower component comprising:

i. an inflatable central section of I-beam construction, including a valve therein, and defining peripheral sides; and ii. an inflatable frame attached to the central section of the lower component surrounding the peripheral sides thereof but lacking fluid communication therewith, the frame defining:

A. an upper surface; and

B. a peripheral edge including a valve therein; and b. an upper component attached to the lower component but lacking fluid communication therewith, the upper component lacking down and comprising:

i. an inflatable, quilted central section of X-beam construction and defining peripheral sides; and ii. an inflatable frame attached to the central section of the upper component surrounding the peripheral sides thereof and defining:

A. a peripheral edge; and

B. a lower surface sealed to the upper surface of the frame of the lower component at a position other than at the peripheral edge of either frame so that the seal is not readily visible therefrom; and iii. at least one valve included therewith for inflation of at least one of the central section and frame of the upper component.

* * * * *